US007406734B2

(12) United States Patent
Mai et al.

(10) Patent No.: US 7,406,734 B2
(45) Date of Patent: Aug. 5, 2008

(54) AIR INFLATION CUSHION WITH CELLS HAVING HELICAL EDGES

(76) Inventors: Chin-Tien Mai, 235 Chung-Ho Box 8-24, Taipei (TW); Chin-Sheng Mai, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/635,343

(22) Filed: Dec. 8, 2006

(65) Prior Publication Data

US 2008/0134440 A1 Jun. 12, 2008

(51) Int. Cl.
*A47C 27/10* (2006.01)

(52) U.S. Cl. ..... 5/654; 5/710

(58) Field of Classification Search ..... 5/654, 5/710, 655.3

See application file for complete search history.

(56) References Cited

U.S. PATENT DOCUMENTS 4,698,864 A * 10/1987 Graebe ..... 5/654
D355,558 S * 2/1995 Graebe ..... D6/604
5,533,220 A * 7/1996 Sebag et al. ..... 5/654

* cited by examiner

*Primary Examiner*—Alexander Grosz

(57) ABSTRACT

An air inflation cushion with cells having helical edges comprises a lower sheet; an upper cushion portion adhered upon the lower sheet; the upper cushion portion including at least one air inflation cell; each air inflation cell having an approximate rectangular cross section and being supported by four helical edges for enhancing the structure of the cell; upper ends of the helical edges being formed as rectangular upper planes; the four helical edges dividing the air inflation cell into four lateral surfaces; a lower portion of each lateral surface being formed with a convex cambered protrusion; and an air tap at one of the cells and extending from one of the helical edges. The air inflation cushion is made of black rubber. The cell is extended with a communication trench which causes two adjacent cells are communicated to one another.

5 Claims, 3 Drawing Sheets

AIR INFLATION CUSHION WITH CELLS HAVING HELICAL EDGES

FIELD OF THE INVENTION

The present invention relates to cushions, and particularly to an air inflation cushion with cells having helical edges, wherein the cushion comprises a lower sheet; an upper cushion portion adhered upon the lower sheet; the upper cushion portion including at least one air inflation cell; each air inflation cell having approximate rectangular cross sections and being supported by four helical edges for enhancing the structure of the cell; upper ends of the helical edges being formed as an rectangular upper plane of the air inflation cell; the four helical edges dividing the air inflation cell into four lateral surfaces; a lower portion of each lateral surface is formed with a convex cambered protrusion.

BACKGROUND OF THE INVENTION

Referring to FIG. 4, a prior art air inflation cushion is illustrated. The air inflation cushion includes the following elements. A lower sheet is included. An upper cushion portion is adhered upon the lower sheet. The upper cushion portion includes at least one air inflation cell. Each air inflation cell has an approximate rectangular cross section and is supported by four cambered edges for enhancing the structure of the cell. The four edges divide the air inflation cell into four lateral surfaces. If the number of the cell is greater than two, then the cell is extended with a communication trench which causes two adjacent cells are communicated to one another. An air tap is at one of the cells and extends from one of the helical edges. Preferably the air tap is inclined to a lower seat of the upper cushion portion and the opening of the air tap faces upwards.

However, in the above mentioned prior art, in venting air, the cambered edges can not make air within the cushion completely vent out due to the design of the cambered edges. When the cells are inflated, the cells are expanded so that the cells are in contact with each other and thus airflow is low and the skin of the body can not be cleaned effectively. Thus for a long time, the user easily gets bedsore, or other skin diseases. Furthermore the cambered edges of the cells make the cushion being soft and thus the user's pose is affected, even the user will feel unstably as sits or lies upon the cushion. As the cushion is used for a long time, the circulation of blood is not good and thus the health of the user will be affected.

SUMMARY OF THE INVENTION

Accordingly, the primary object of the present invention is to provide an air inflation cushion with cells having helical edges, wherein the helical edges can disperse the air to flow upwards along the helical edges so as to clean the body of the users and dissipate heat from the user's body. The user will feel comfortable. The user will not get bedsore or other skin diseases as lie upon on the cushion for a long time.

Another object of the present invention is to provides an air inflation cushion with cells having helical edges, wherein the helical edges provide a longer length than that in the prior art and thus the present invention can suffer from a great pressure and is difficult to deform so that the structure and shape of the cushion can be retained for a long time.

To achieve above objects, the present invention provides an air inflation cushion with cells having helical edges. The cushion comprises a lower sheet; an upper cushion portion adhered upon the lower sheet; the upper cushion portion including at least one air inflation cell; each air inflation cell having an approximate rectangular cross section and being supported by four helical edges for enhancing the structure of the cell; upper ends of the helical edges being formed as rectangular upper planes; the four helical edges dividing the air inflation cell into four lateral surfaces; a lower portion of each lateral surface being formed with a convex cambered protrusion; and an air tap at one of the cells and extending from one of the helical edges. The air inflation cushion is made of black rubber. The cell is extended with a communication trench which causes that two adjacent cells are communicated to one another.

When the lower sheet is combined to the upper cushion portion, the communication trenches between the air inflation cells are formed as air tubes. The design of the four helical edges and the four convex cambered protrusions will make the cell expand fully. The four convex cambered protrusions will cause the cell to be flat and smooth as air is fully released from the cell and moreover, when air is inflated into the cell, the air inflation cell can be inflated fully as a hot air balloon. The helical edges have the effect of enhancing the structure.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
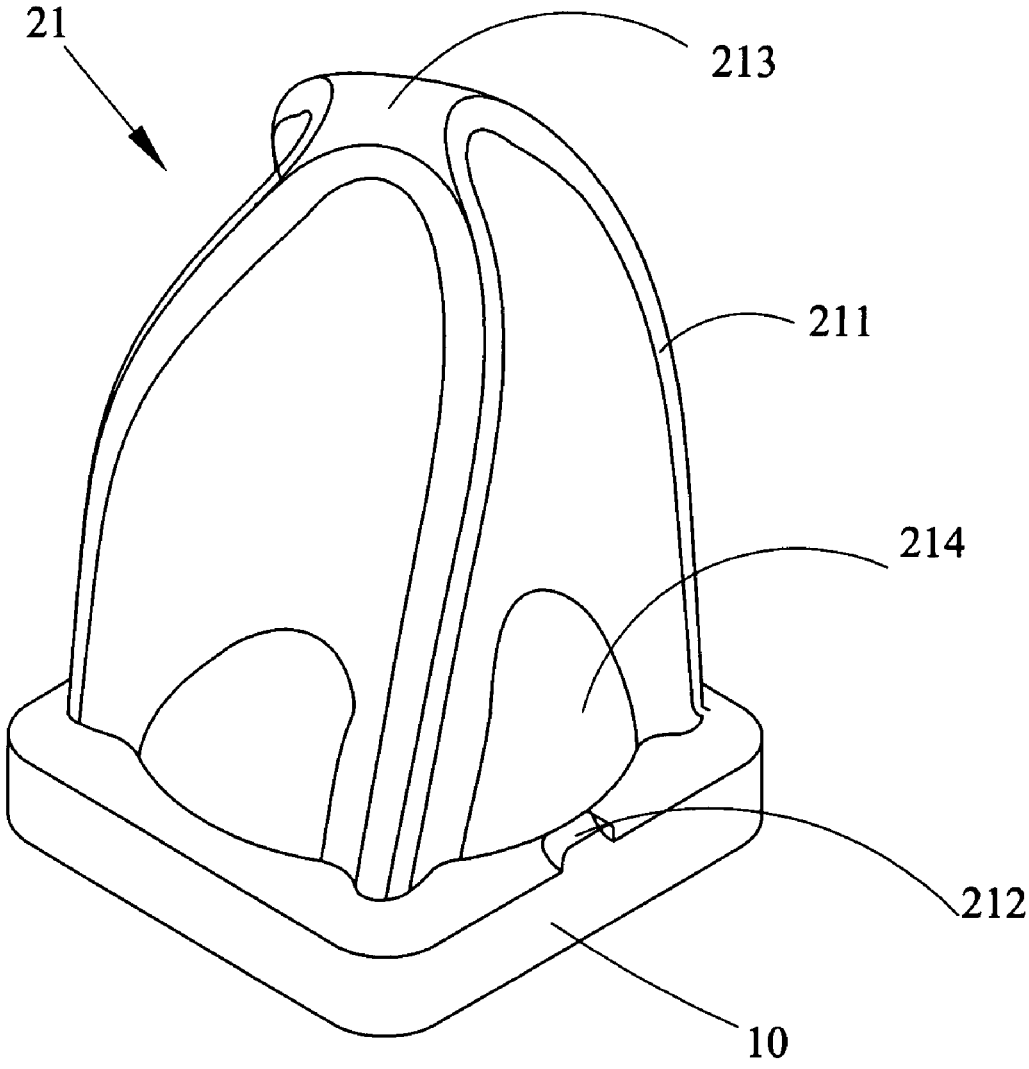
FIG. 1 is a perspective view of the present invention.
Figure 2:
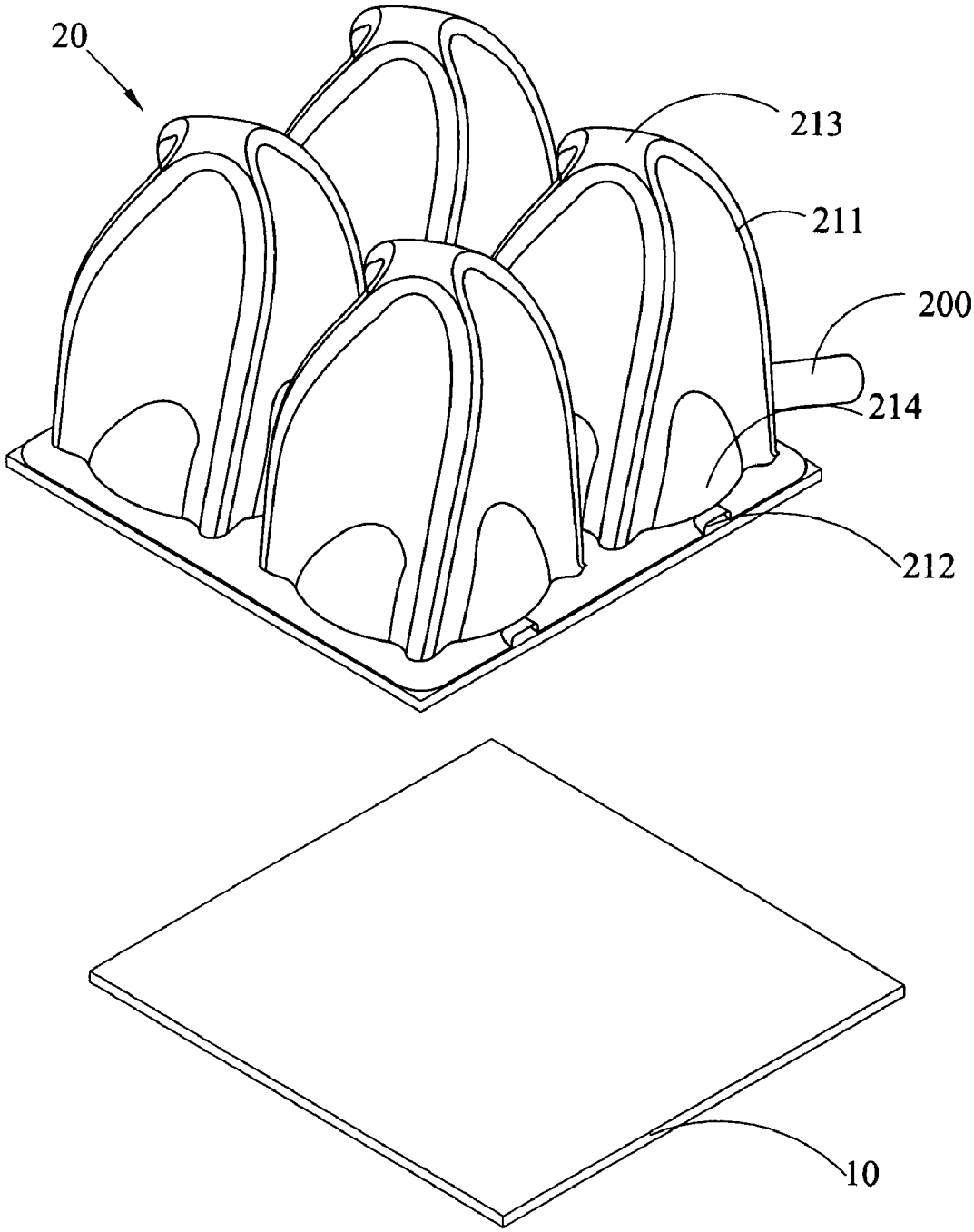
FIG. 2 is an exploded view of a plurality of cells according to the present invention.
Figure 3:
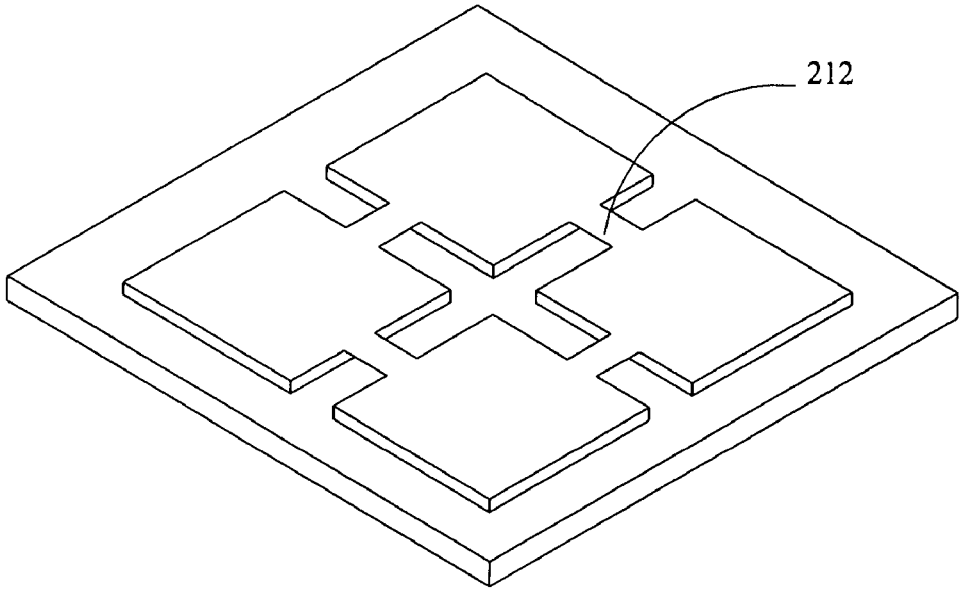
FIG. 3 shows a lower seat of the upper cushion portion of the present invention.
Figure 4:
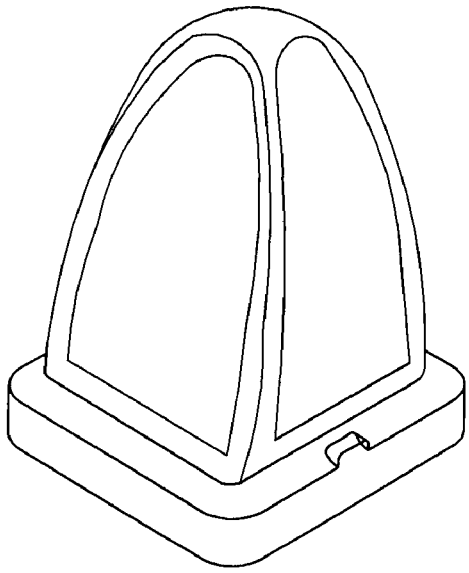
Fig. 4 (Prior Art)
FIG. 4 is shows the prior art cells in an air inflation cushion.

Referring to FIGS. 1 to 3, the air inflation cushion with cells having helical edges according to the present invention is illustrated. The cushion comprises the following elements.

A lower sheet 10 is included. The lower sheet 10 is made of black rubber or colored rubber. Black rubber is a preferable one.

An upper cushion portion 20 is adhered upon the lower sheet 10. Preferably, the upper cushion portion 20 is made of black rubber or colored rubber. Black rubber is a preferable one, for example, mixture material of Neoprene and carbon (pantone 419C). The upper cushion portion 20 includes at least one air inflation cell 21. Each air inflation cell 21 has an approximate rectangular cross section and is supported by four helical edges 211 for enhancing the structure of the cell. Upper ends of the helical edges 211 are formed as rectangular upper planes 213 of the air inflation cell 21. The four helical edges 211 divide the air inflation cell 21 into four lateral surfaces. A lower portion of each lateral surface is formed with a convex cambered protrusion 214. If the number of the cell is greater than two, then the cell is extended with a communication trench 212 which causes that two adjacent cells are communicated to one another (FIG. 2).

An air tap 200 (or air valve) is at one of the cells and extends from one of the helical edges 211. Preferably the air tap is inclined to a lower seat of the upper cushion portion 20 with an angle of, preferably, about 5 degrees (FIG. 2) from the lower seat and the opening of the air tap faces upwards.

When the lower sheet 10 is combined to the upper cushion portion 20, the communication trenches 212 between the air inflation cells 21 are formed as air tubes. The design of the four helical edges 211 and the four convex cambered protrusions 214 will make the cell expand fully. The four convex cambered protrusions 214 will cause the cell to be flat and smooth as air is fully released from the cell and moreover, when air is inflated into the cell, the air inflation cell 21 can be inflated fully as a hot air balloon. The helical edges 211 have the effect of enhancing the structure.

The present invention has wide applications, such as chairs, vehicles, seat cushions, beds, etc. Black rubber (such as pantone 419C, or mixture material of Neoprene and carbon.) is preferably. If the secretions or excrements from the users pollute the cushion, it will not be seen due to the black cushion. Thus the users will not feel uneasy or feel insalutary.

The helical edges 211 of the air inflation cells 21 present beautiful visual feeling to users. The upper plane 213 has comfortable feeling to users even the cells do not expand fully, the upper plane 213 of the cell can disperse the force applied to the user. In the present invention, the cells are communicated through the designs of the communication trenches 212 of the cells so that the pressures can be uniformly distributed upon the cushion. Thus the user can seat upon the cushion stably.

Advantages of the present invention better than the prior art are that the helical edges 211 can disperse air so that the air flows upwards along the helical edges so as to clean the body of the users and dissipate heat from the user's body. The user will feel comfortable. The user will not get bedsore or other skin diseases as lie upon on the cushion for a long time.

Moreover, the helical edges 211 provide a longer length than that in the prior art and thus the present invention can suffer from a great pressure and is difficult to deform so that the structure and shape of the cushion can be retained for a long time.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An air inflation cushion with cells having helical edges comprising:

a lower sheet;

an upper cushion portion adhered upon the lower sheet; the upper cushion portion including at least one air inflation cell; each air inflation cell having an approximate rectangular cross section and being supported by four helical edges for enhancing a structure of the cell;

upper ends of the helical edges being formed as a rectangular upper plane of the air inflation cell; the four helical edges dividing the air inflation cell into four lateral surfaces; a lower portion of each lateral surface being formed with a convex cambered protrusion; and an air tap at one of the cells and extending from one of the helical edges.

2. The air inflation cushion with cells having helical edges as claimed in claim 1, wherein the air inflation cushion is made of black rubber.

3. The air inflation cushion with cells having helical edges as claimed in claim 1, wherein the air inflation cushion is made of a mixture material of neoprene and carbon.

4. The air inflation cushion with cells having helical edges as claimed in claim 1, wherein the air tap is inclined to a lower seat of the upper cushion portion with an angle of about 5 degrees with respect to the lower seat and an opening of the air tap faces upwards.

5. The air inflation cushion with cells having helical edges as claimed in claim 1, wherein the cell is extended with a communication trench which causes two adjacent cells to communicate with one another if the number of cells is greater than 2.

* * * * *